US006138601A

United States Patent [19]

Anderson et al.

[11] Patent Number: 6,138,601

[45] Date of Patent: Oct. 31, 2000

[54] BOAT HULL WITH CONFIGURABLE PLANING SURFACE

[75] Inventors: Glenn Anderson, Oshkosh; John O. Scherer, Hartford, both of Wis.

[73] Assignee: Brunswick Corporation, Lake Forest, Ill.

[21] Appl. No.: 09/258,455

[22] Filed: Feb. 26, 1999

[51] Int. Cl.[7] ..... B63B 1/22

[52] U.S. Cl. ..... 114/285; 114/286

[58] Field of Search ..... 114/271, 285, 114/286, 287, 284, 145 A, 145 R, 274, 291; D12/311, 313, 317

[56] References Cited

U.S. PATENT DOCUMENTS

| | | | |
|---|---|---|---|
| 1,779,075 | 10/1930 | Plum . | |
| 1,875,135 | 8/1932 | Plum . | |
| 2,780,195 | 2/1957 | Keikhaefer | 114/285 |
| 3,058,442 | 10/1962 | Curtis . | |
| 3,149,351 | 9/1964 | Plum . | |
| 3,159,131 | 12/1964 | Frederick . | |
| 3,379,158 | 4/1968 | Plum . | |
| 3,463,109 | 8/1969 | Weiler . | |
| 3,468,282 | 9/1969 | Wintercorn . | |
| 3,577,948 | 5/1971 | Frey . | |
| 3,589,323 | 6/1971 | Kercheval . | |
| 3,601,078 | 8/1971 | Bedford, Jr. . | |
| 3,760,759 | 9/1973 | Lang . | |
| 3,763,810 | 10/1973 | Payne . | |
| 3,777,694 | 12/1973 | Best . | |
| 3,802,370 | 4/1974 | Collier . | |
| 3,807,337 | 4/1974 | English et al. . | |
| 3,834,345 | 9/1974 | Hager et al. . | |
| 3,974,790 | 8/1976 | Oldengurg . | |
| 3,982,493 | 9/1976 | Cronin . | |
| 3,996,869 | 12/1976 | Hadley . | |
| 4,058,077 | 11/1977 | Johansson . | |
| 4,232,626 | 11/1980 | Kern . | |
| 4,318,699 | 3/1982 | Wenstadt et al. . | |
| 4,401,888 | 8/1983 | West et al. . | |
| 4,406,635 | 9/1983 | Wührer . | |
| 4,458,622 | 7/1984 | Anderson . | |
| 4,519,336 | 5/1985 | Mason . | |
| 4,565,528 | 1/1986 | Nakase . | |
| 4,644,890 | 2/1987 | Lott . | |
| 4,657,513 | 4/1987 | Baker . | |
| 4,718,872 | 1/1988 | Olson et al. . | |
| 4,749,926 | 6/1988 | Ontolchik . | |
| 4,762,079 | 8/1988 | Takeuchi et al. . | |
| 4,843,988 | 7/1989 | Clement . | |
| 4,854,259 | 8/1989 | Cluett . | |
| 4,896,621 | 1/1990 | Coles . | |
| 4,908,766 | 3/1990 | Takeuchi . | |
| 4,909,175 | 3/1990 | Arnseson . | |
| 4,967,682 | 11/1990 | O'Donnell . | |
| 5,058,520 | 10/1991 | Fahrney . | |
| 5,113,780 | 5/1992 | Bennett et al. . | |
| 5,169,348 | 12/1992 | Ogiwara et al. . | |
| 5,193,478 | 3/1993 | Mardikian . | |
| 5,263,432 | 11/1993 | Davis . | |
| 5,315,951 | 5/1994 | Finkl . | |
| 5,352,137 | 10/1994 | Iwai et al. . | |
| 5,383,419 | 1/1995 | Stevens . | |
| 5,385,110 | 1/1995 | Bennett et al. . | |
| 5,390,623 | 2/1995 | Mackaness . | |
| 5,443,026 | 8/1995 | Wenstadt et al. . | |

(List continued on next page.)

*Primary Examiner*—Ed Swinehart
*Attorney, Agent, or Firm*—Andrus, Sceales, Starke & Sawall, LLP

[57] ABSTRACT

A Vee bottom planing boat hull (32) has right and left steps (44 and 46) positioned so as to optimize the boat's trim angle at top speed, and defining right and left notches (48 and 50) in which are pivotally mounted left and right trim tabs (56 and 58) having forward leading edges (60 and 62) along oblique pivot axes (64 and 66) causing outer corners (102 and 104) of trailing edges (68 and 70) of the trim tabs to move downwardly more than inner corners (106 and 108) during downward pivoting of the trim tabs, providing an active hull to control boat trim angle and effectively reduce deadrise angle while maintaining a running surface trailing edge substantially free of discontinuities in the vertical direction.

10 Claims, 5 Drawing Sheets

U.S. PATENT DOCUMENTS 5,474,012 12/1995 Yamada et al. .
5,524,567 6/1996 Astley et al. .
5,549,071 8/1996 Pigeon et al. .
5,628,272 5/1997 Thomas .
5,685,253 11/1997 Alexander, Jr. .
5,719,358 2/1998 Lindholm ..... 181/235
5,806,455 9/1998 Buzzi .

BOAT HULL WITH CONFIGURABLE PLANING SURFACE

BACKGROUND AND SUMMARY

The invention relates to Vee bottom planing boat hulls, and more particularly to controllably variable hydrodynamic planing surface configurations.

The invention arose during development efforts directed toward active hull planing surface design to improve the overall efficiency of the boat as it operates over its speed, weight, and center of gravity range. In one such design effort, this is done by forming a notch in the boat bottom by putting a step forward of the transom, to improve the trim angle of the boat at high speeds, and then using an integrated trim tab to provide lift at the rear of the boat to limit the boat's trim angle at lower speeds.

In one embodiment, optimum planing efficiency occurs at a boat trim angle of roughly 4.5°, although trim angle must be reduced as speed increases, to prevent porpoising. To achieve this optimum, a boat with a single running surface must be balanced with its center of gravity in a position fore-aft such that the boat is hydrodynamically balanced on the running surface at the desired trim angle. As boat speed increases, the immersed, roughly triangular, lifting portion of the hull must be smaller if trim angle is to be maintained. This requires that the center of forces acting on the boat must move aft to maintain the balance on the now smaller more rearward planing surface. Unstepped rigid-hull boats achieve this shifting of the center of force, to some extent, by tilting the drive unit to change the angle of the thrust vector. If the boat is to operate over a wide speed range, the drive tilt angle required to maintain boat trim becomes large and leads to loss of the forward thrust component, and increased drag.

An active hull design, controllably varying the planing surface configuration, allows the boat to achieve near optimum trim angles over a wide range of boat speeds. In one embodiment, the boat bottom is stepped forward of the transom a distance such that the boat trim angle at top speed is just below the porpoising limit. At lower speeds, the boat sinks farther into the water, causing the running surface to extend further forward, and the center of lift to move forward, increasing the trim angle, leading to porposing, higher drag, and obscured visibility at very low planing speeds, near the hump speed.

In one embodiment, active boat hull bottom trim tabs are provided in notches predominantly behind steps with lower surfaces offset upwards from the lower edges of the steps, and hinged so that they can be retracted upwards from and also depressed below a respective plane parallel to the boat bottom. In the retracted position, used at high speed, the tab remains clear of the water flow which separates from the step and is completely ventilated from the rear. At lower speeds, the tab is pivoted downwardly to an angle such that it produces the required amount of lift to reduce the boat trim angle to the desired value.

In one embodiment, a further enhancement is achieved by angling the pivot axis hinge line forwardly towards the chine. The step may or may not also be so angled. The angled hinge line causes the trailing edge of the tabs to move downwardly more on their outboard end than on their inboard end, effectively reducing the deadrise angle of the hull, and maintaining a running surface trailing edge free from discontinuities in the vertical direction. This has been beneficial for shaping the wake, improving skiing, wakeboarding, and the like.

In one aspect, the tabs can be operated differentially to control the roll angle of the boat, both straight ahead, and in turns, and to enhance steering. The steering enhancement is particularly valuable on boats with jet-type drives which do not have good off-throttle steering characteristics.

BRIEF DESCRIPTION OF THE DRAWINGS

FIG. 7 is an end view of the structure of FIG. 6.

FIG. 9 is an end view of the: structure of FIG. 8.

FIG. 11 is an end view of the structure of FIG. 10.

DETAILED DESCRIPTION OF THE INVENTION

Figure 1:
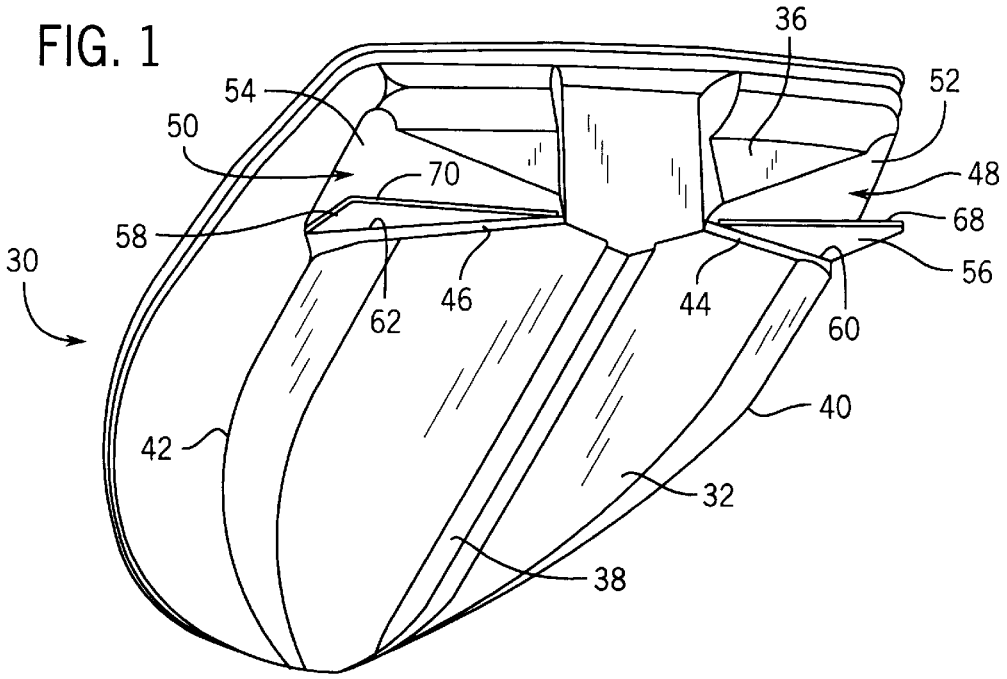
FIG. 1 is a isometric view from below of a Vee bottom planing boat in accordance with the invention.
Figure 2:
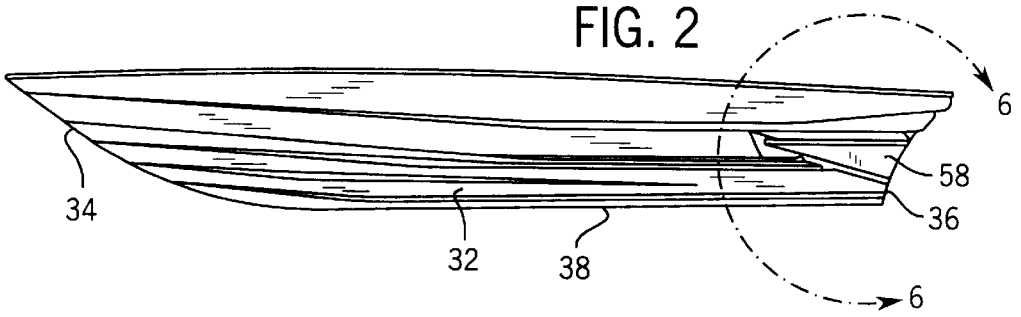
FIG. 2 is a side elevation view of the boat of FIG. 1.
Figure 3:
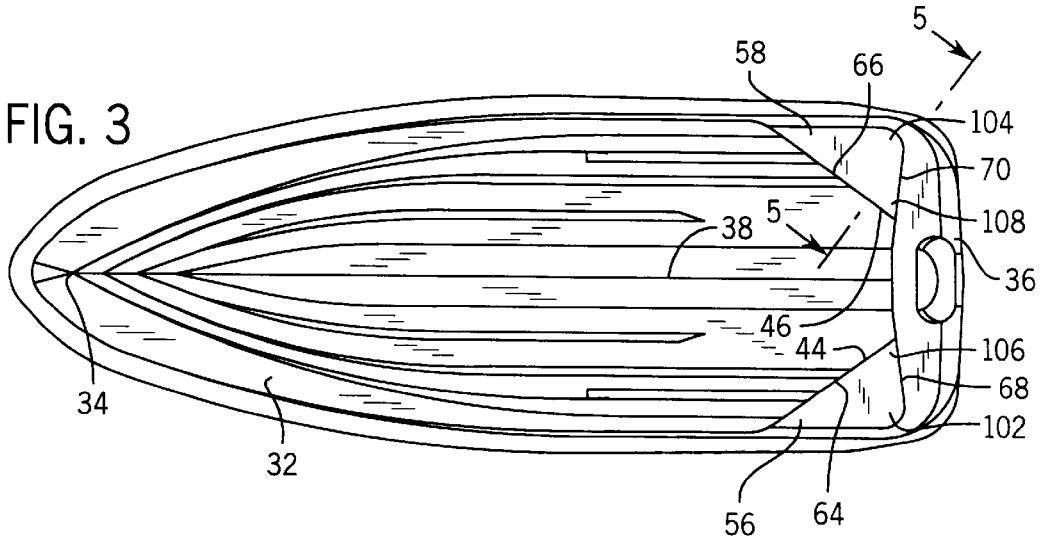
FIG. 3 is a bottom elevation view of the boat of FIG. 2.

FIGS. 1–3 show a Vee bottom planing boat 30 having a hull 32 extending from a bow 34 rearwardly to a transom 36. The hull has a central longitudinally extending keel 38, and right and left longitudinally extending chines 40 and 42 spaced laterally outwardly and upwardly from keel 38. Right and left steps 44 and 46 in the hull on respective right and left sides of the keel define right and left notches 48 and 50 with respective right and left raised undersufaces 52 and 54 each extending rearwardly from its respective step 44 and 46 to transom 36. Right and left pivotable trim tabs 56 and 58 have forward ends 60 and 62 pivotally mounted to the hull at respective right and left pivot axes 64 and 66, FIG. 3, in respective right and left notches 48 and 50. Trim tabs 56 and 58 are triangular, with one side of the triangle being the forward leading edge 60 and 62, respectively, extending at an oblique angle relative to keel 38. Trim tabs 56 and 58 extend rearwardly from their forward ends 60 and 62 along notches 48 and 50 to rearward edges 68 and 70.

Figure 12:
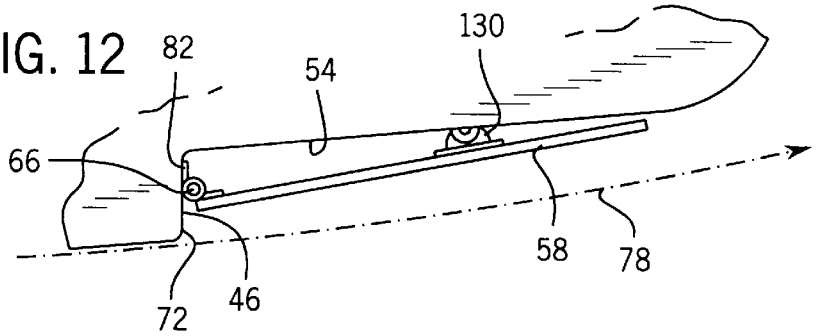
FIG. 12 is a schematic view illustrating the operational condition of FIGS. 8 and 9.
Figure 13:
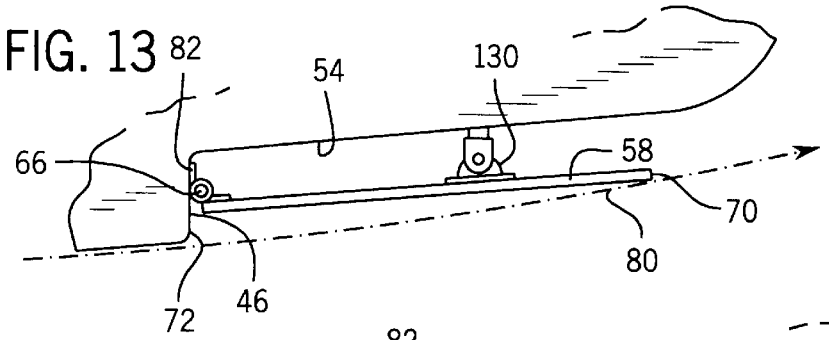
FIG. 13 is like FIG. 12 and shows the operational condition of FIGS. 6 and 7.
Figure 14:
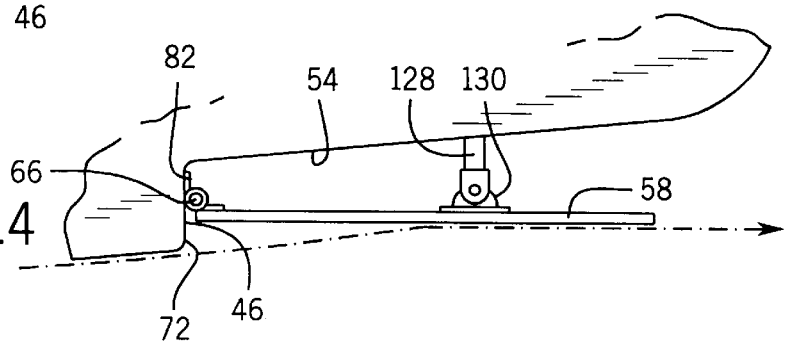
FIG. 14 is like FIG. 12 and shows the operational condition of FIGS. 10 and 11.
Figure 5:
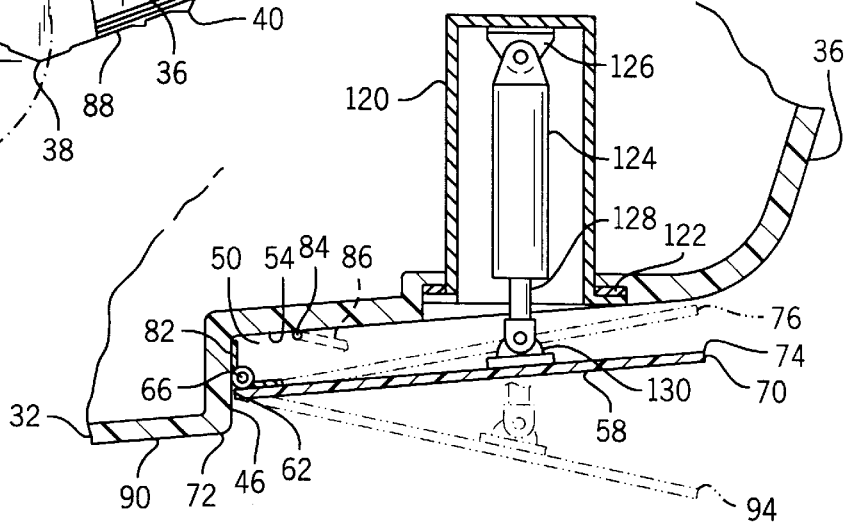
FIG. 5 is a sectional view taken along line 5—5 of FIG. 3.
Figure 6:
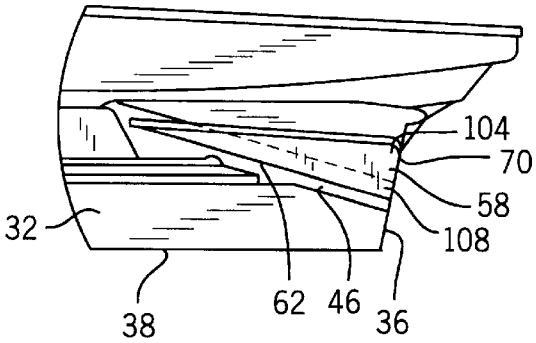
FIG. 6 is an enlarged view of a portion of the structure shown in FIG. 2, as noted at line 6—6.
Figure 7:
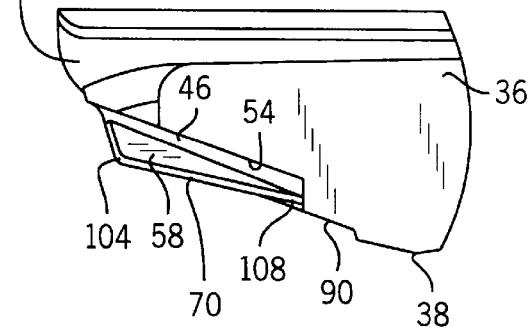
FIG. 7 is an enlarged view of a portion of the structure shown in FIG. 4, as noted at line 7—7.
Figure 8:
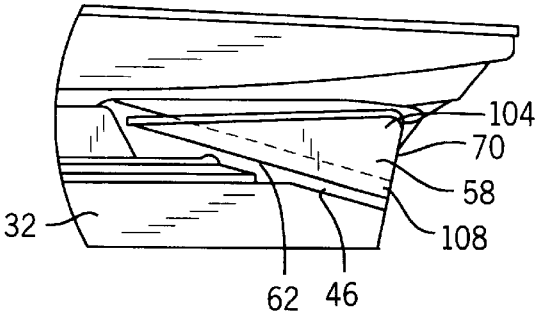
FIG. 8 is a view like FIG. 6 and shows another operational condition.
Figure 9:
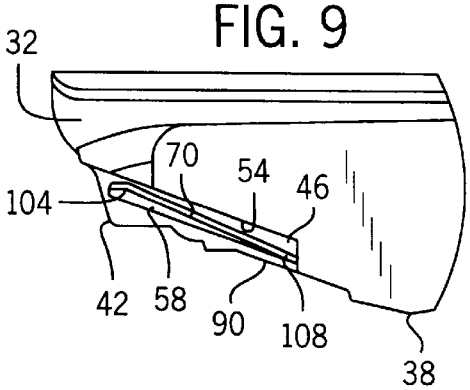
FIG. 9 is a view like FIG. 7 and shows another operational condition.
Figure 10:
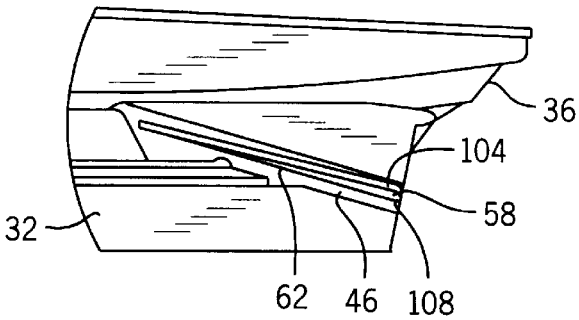
FIG. 10 is a view like FIG. 6 and shows another operational condition.
Figure 11:
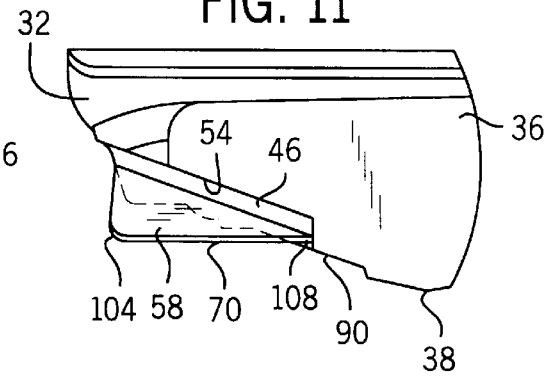
FIG. 11 is a view like FIG. 7 and shows another operational condition.

The forward ends of the trim tabs are preferably spaced above the bottoms of the right and left steps, respectively, for example, as shown in FIG. 5 where forward end 62 of trim tab 58 is spaced above the bottom 72 of step 46. Trim tab 58 has an intermediate pivoted position substantially parallel to the boat bottom, as shown in solid line at 74 in FIG. 5, and as shown in FIGS. 6, 7, 13, 15–17. The trim tabs have an upwardly pivoted position as shown in FIG. 5 at dashed line 76, and as shown in FIGS. 8, 9, 12. In at least position 76, down to about position 74, it is desired that water breaking off lower edge 72 of step 46 does not contact or re-attach to the trim tab as shown in FIGS. 12 and 13 where respective water lines 78 and 80 do not re-attach to the trim tab. The depiction in FIGS. 12 and 13 is schematic, and the pivoted position of the trim tab in FIG. 13 is intended to illustrate the position at which water line 80 barely grazes rear end 70 of trim tab 58. The actual position of trim tab 58 in FIG. 13 may be slightly upwards therefrom at the grazing point, due to slight upward curving of water line 80. The desired hydrodynamic water flow pattern schematically illustrated in FIGS. 12 and 13 is more readily enabled by mounting the trim tab to the hull at pivot bracket 82 such that forward end 62 of the trim tab is above bottom 72 of step 46. Forward end 62 of the trim tab may be mounted at other vertical locations along step 46, including the top or the bottom thereof. Further alternatively, the trim tab may be mounted at a location spaced aft of step 46 along raised undersurface 54, as shown in dashed line in FIG. 5 at forward end 84 of trim tab 86. It is preferred that the pivot axes 64 and 66 of the trim tabs be at respective steps 44 and 46, though the pivot axes of the trim tabs may be spaced aft of the steps, as noted, FIG. 5.

Figure 24:
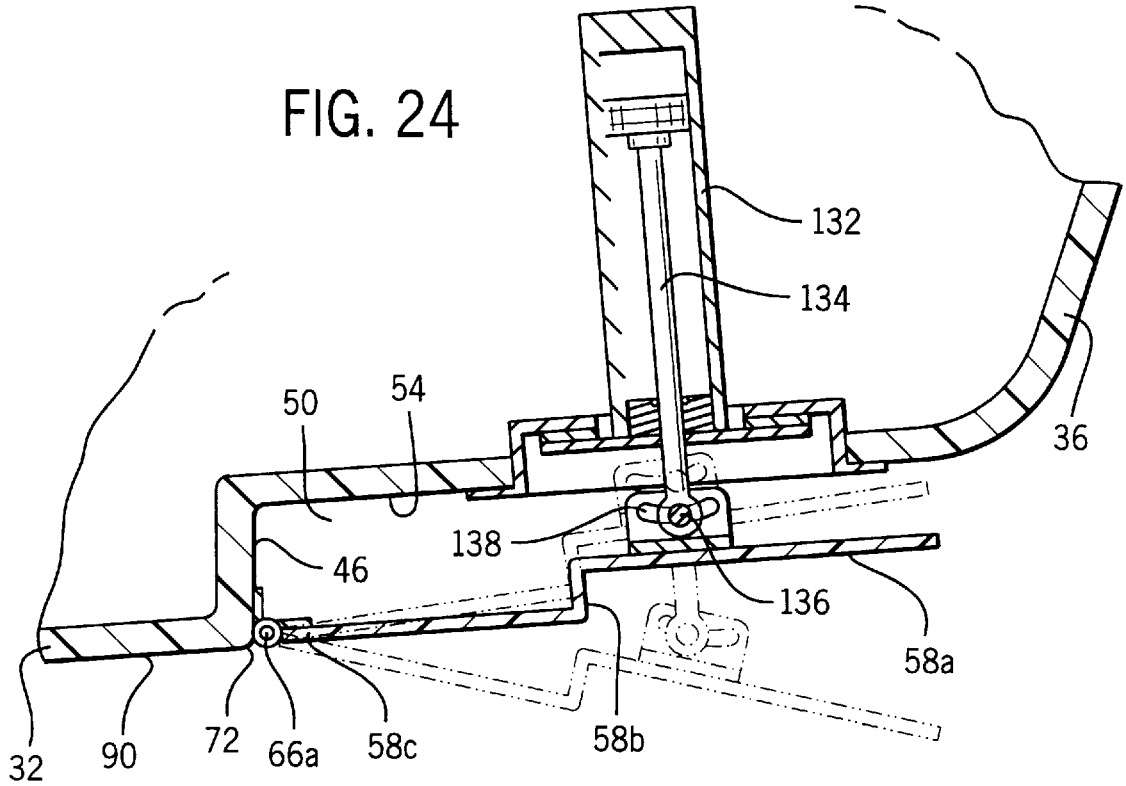
FIG. 24 is like FIG. 5 and shows another embodiment.

In another alternative, FIG. 24, right and left substeps are provided in respective right and left trim tabs, for example as shown at trim tab 58*a* having substep 58*b*. In such embodiment, the pivot axis of the trim tabs are spaced forward of such substeps, as shown at pivot axis 66*a* spaced forward of substep 58*b*. The right and left substeps are spaced aft of the noted right and left steps in the hull, for example as shown at substep 58*b* spaced aft of step 46. In this embodiment, the forward ends of the trim tabs are at the bottoms of the steps in the hull, as shown at forward end 58*c* of trim tab 58*a* at the bottom 72 of step 46, such that, at top speed and with the trim tabs pivoted to a given intermediate position as shown in solid line in FIG. 24, water continues flush along hull undersurface 90 and the forward portion 58*c* of the trim tab and then breaks off the bottom of substep 58*b*.

It is preferred that both the steps 44 and 46 and the pivot axes 64 and 66 of the trim tabs extend at oblique angles relative to the keel. In alternate embodiments, the pivot axes extend at oblique angles, but not necessarily the steps. It is preferred that the pivot axes and the steps extend at the same oblique angles, such that right pivot axis 64 is parallel to right step 44, and left pivot axis 66 is parallel to left step 46.

Figure 4:
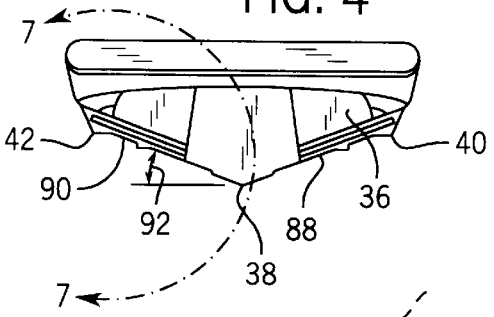
FIG. 4 is an end elevation view of the boat of FIG. 2.
Figure 15:
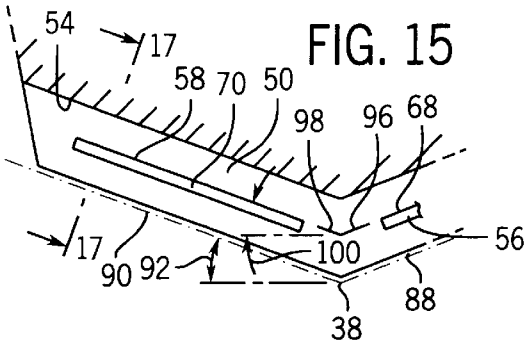
FIG. 15 is a schematic rear view illustrating the operational condition of FIGS. 6, 7, 13.
Figure 16:
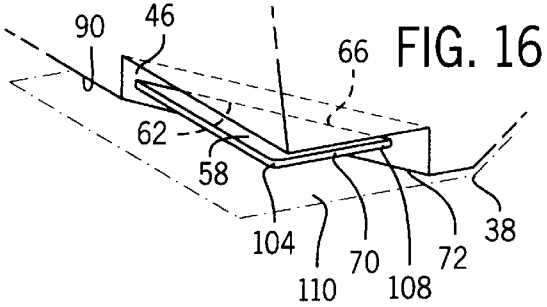
FIG. 16 is a schematic isometric view illustrating the operational condition of FIGS. 6, 7, 13, 15.
Figure 17:
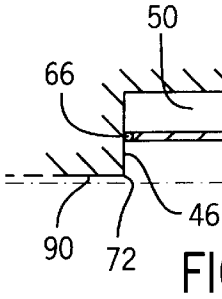
FIG. 17 is a schematic side view illustrating the operational condition of FIGS. 6,7, 13, 15, 16.
Figure 18:
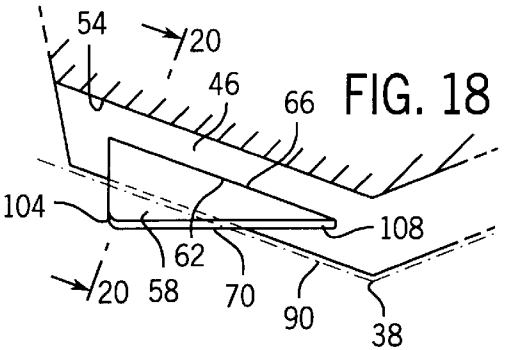
FIG. 18 is a schematic rear view illustrating the operational condition of FIGS. 10, 11, 14.
Figure 19:
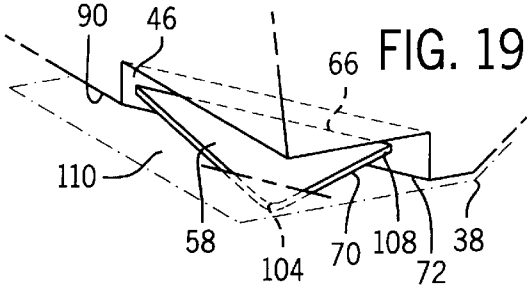
FIG. 19 is a schematic isometric view illustrating the operational condition of FIGS. 10, 11, 14, 18.
Figure 20:
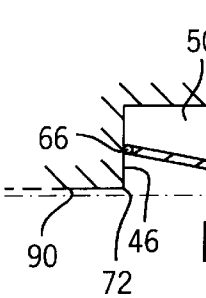
FIG. 20 is a schematic side view illustrating the operational condition of FIGS. 10, 11, 14, 18, 19.
Figure 21:
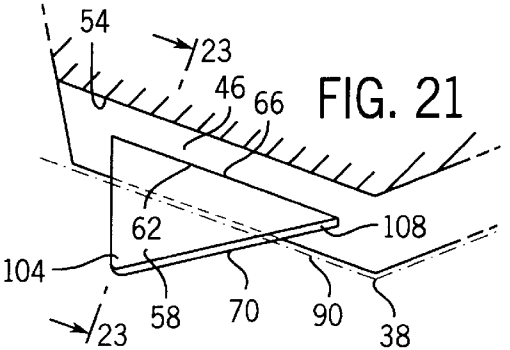
FIG. 21 is a view like FIG. 18 and shows a further operational condition.
Figure 22:
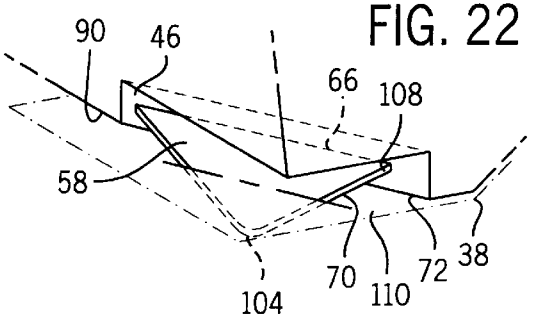
FIG. 22 is like FIG. 19 and shows the further operational condition of FIG. 21.
Figure 23:
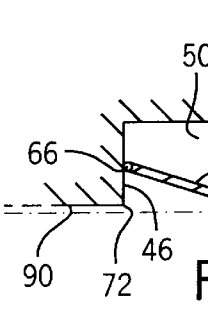
FIG. 23 is like FIG. 20 and shows the further operational condition of FIGS. 21, 22.

The hull has right and left planing undersurfaces 88 and 90, FIG. 4, meeting at keel 38 and defining a hull deadrise angle 92, FIG. 15. The trim tabs have the noted intermediate position, as shown at 74 in FIG. 5, between the noted upwardly pivoted position as shown in dashed line at 76, and a downwardly pivoted position as shown in dashed line at 94. The intermediate position of the trim tabs is also shown in FIGS. 6, 7, 13, 15–17. The upwardly pivoted position of the trim tabs is shown in FIGS. 8, 9, 12. The downwardly pivoted position of the trim tabs is shown in FIGS. 10, 11, 14, 18–20, and a further downwardly pivoted position is shown in FIGS. 21–23. The aft ends 68 and 70 of the trim tabs in the noted intermediate position 74 extend along projections 96 and 98, FIG. 15, forming an angle 100 equal to deadrise angle 92 when aft ends 68 and 70 of trim tabs 56 and 58 are parallel to right and left planing undersurfaces 88 and 90, respectively, of the hull. Aft ends 68 and 70 of trim tabs 56 and 58 in the noted downwardly pivoted position 94 are nonparallel to right and left planing undersurfaces 88 and 90, respectively, of the hull.

As noted, pivot axes 64 and 66 of triangular trim tabs 56 and 58 are angled and extend at oblique angles relative to keel 38. Pivot axes 64 and 66 diverge away from each other and towards respective chines 40 and 42 as the pivot axes extend forwardly. Angled pivot axes 64 and 66 cause respective outer corners 102 and 104, FIG. 3, of trailing edges 68 and 70 of trim tabs 56 and 58 to move downwardly more than inner corners 106 and 108 of trailing edges 68 and 70 as trim tabs 56 and 58 are pivoted downwardly. This effectively reduces the noted deadrise angle of the hull, and maintains a running surface trailing edge substantially free of discontinuities in the vertical direction, which is beneficial for shaping the wake, improving skiing, wakeboarding, and the like. As seen in a comparison of FIGS. 16 and 19, upon downward pivoting of trim tab 58 about pivot axis 66 along forward leading trim tab edge 66 along step 46, outer corner 104 of trailing edge 70 moves downwardly more than inner corner 108 and breaks the plane 110 of the water, FIGS. 19 and 20. FIGS. 21–23 show yet further downward pivoted action.

The pivotable trim tabs may be actuated in various manners. In one embodiment, FIG. 5, a cylindrical canister 120 is mounted to the hull at raised undersurface 54 at sealing gasket 122 and extends upwardly into the boat. A hydraulic cylinder 124 is pivotally mounted at bracket 126 to the top of the cylinder, and has a lower extendable and retractable plunger rod 128 pivotally mounted to the trim tab at bracket 130. In an alternative, FIG. 24, a hydraulic cylinder 132 is fixedly mounted to the hull in a stationary position and has an extendable and retractable plunger rod 134 pivotally mounted to trim tab 58*a* by Turin 136 slidable along arcuate slot 138 to accommodate pivoting of the trim tab.

It is recognized that various equivalents, alternatives and modifications are possible within the scope of the appended claims.

What is claimed is:

1. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said forward ends of said right and left trim tabs are spaced above the bottoms of said right and left steps, respectively, such that, at top speed and with said trim tabs pivoted upwardly, water breaks off said bottoms of said steps and does not re-attach to said trim tabs.

2. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said steps extend at oblique angles relative to said keel.

3. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said pivot axes extend at oblique angles relative to said keel.

4. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said right pivot axis is parallel to said right steps and said left pivot axis is parallel to said left step, and wherein said steps and said pivot axes extend at oblique equal angles relative to said keel.

5. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said hull has right and left planing undersurfaces meeting at said keel and defining a hull deadrise angle, said trim tabs have an intermediate position between upwardly pivoted and downwardly pivoted positions, and wherein the aft ends of said trim tabs in said intermediate position extend along projections forming an angle equal to said hull deadrise angle wherein said aft ends of said right and left trim tabs are parallel to said right and left planing undersurfaces, respectively, of said hull, and wherein said aft ends of said trim tabs in said downwardly pivoted position are nonparallel to said right and left planing undersurfaces, respectively, of said hull.

6. The invention according to claim 5 wherein said pivot axes are angled and extend at oblique angles relative to said keel, and diverge away from each other and towards said chines as they extend forwardly.

7. The invention according to claim 6 wherein said angled pivot axes cause outer corners of the trailing edges of said trim tabs to move downwardly more than inner corners of the trailing edges of said trim tabs as said trim tabs are pivoted downwardly, effectively reducing said deadrise angle of the hull, and maintaining a running surface trailing edge substantially free of discontinuities in the vertical direction.

8. A Vee bottom planing boat having a hull extending from a bow rearwardly to a transom, said hull having a central longitudinally extending keel and right and left longitudinally extending chines spaced laterally outwardly and upwardly from said keel, right and left steps in said hull on respective right and left sides of said keel and defining right and left notches with respective right and left raised undersurfaces each extending rearwardly from its respective said step to said transom, right and left pivotable trim tabs having forward ends pivotally mounted to said hull at respective right and left pivot axes in respective said right and left notches and extending rearwardly from said forward ends along said notches, wherein said hull has right and left planing undersurfaces meeting at said keel and defining a hull deadrise angle, said steps are transitions from said planing undersurfaces to said raised undersurfaces, said steps extend along oblique lines relative to said keel, said oblique lines diverge away from each other and towards said chines as they extend forwardly.

9. The invention according to claim 8 wherein said forward ends of said trim tabs are mounted to said steps at points between said planing surfaces and said raised undersurfaces.

10. A Vee bottom planing boat having a hull extending from a bow rearwardly to a transom, said hull having a central longitudinally extending keel and right and left longitudinally extending chines spaced laterally outwardly and upwardly from said keel, said hull having right and left planing undersurfaces meeting at said keel and defining a hull deadrise angle, right and left trim tabs pivotally mounted to said hull and having first and second pivoted positions, said trim tabs having aft ends parallel to said right and left planing undersurfaces, respectively, when said trim tabs are in said first pivoted position, said aft ends of said trim tabs being nonparallel to said right and left planing undersurfaces, respectively, when said trim tabs are in said second pivoted position, wherein said aft ends of said trim tabs extend from inner corners laterally outwardly to outer corners, said outer corners moving through greater ranges of motion than said inner corners during pivoting of said trim tabs, such that water leaving the boat has a flatter and smoother wake when said trim tabs are in said second pivoted position.

* * * * *